United States Patent [19]

Hsu

[11] Patent Number: 4,765,497

[45] Date of Patent: Aug. 23, 1988

[54] TEAT FOR BABY'S FEEDING BOTTLE

[76] Inventor: Shen-Kuang Hsu, 2F., No. 8, Lane 168, Chi Lin Road, Taipei, Taiwan

[21] Appl. No.: 5,763

[22] Filed: Jan. 21, 1987

[51] Int. Cl.[4] ..... A61J 11/00

[52] U.S. Cl. ..... 215/11.1; 215/11.4; 222/490

[58] Field of Search ..... 215/11 R, 11 B–11 E, 215/11.1, 11.3–11.6; 222/490, 541

[56] References Cited

U.S. PATENT DOCUMENTS

| | | | |
|---|---|---|---|
| 1,044,737 | 11/1912 | Bowly | 215/11 B |
| 2,388,915 | 11/1945 | Heilborn | 215/11 B |
| 2,688,326 | 9/1954 | Lerman | 215/11 R |
| 2,816,547 | 12/1957 | Adisman | 215/11 R |
| 2,981,449 | 4/1961 | Perkins | 222/541 |
| 3,500,831 | 3/1970 | Schaar | 215/11 B |

FOREIGN PATENT DOCUMENTS

| | | | |
|---|---|---|---|
| 2302724 | 10/1976 | France | 215/11 R |
| 2102398 | 2/1983 | United Kingdom | 222/490 |

*Primary Examiner*—William Price
*Assistant Examiner*—Sue A. Weaver
*Attorney, Agent, or Firm*—Sherman and Shalloway

[57] ABSTRACT

This invention relates to a teat for a baby's feeding bottle and in particular to one comprising a conical body having two nipples on the top end thereof, each nipple having three protuberances at different sizes, whereby the protuberances may be cut off according to the design such that the smallest of the protuberance is for a baby of three months or below, the larger one for a baby of three to six months and the largest for a baby of more than six months.

2 Claims, 5 Drawing Sheets

TEAT FOR BABY'S FEEDING BOTTLE

BACKGROUND OF THE INVENTION

Referring to FIG. 4, there is shown a prior art teat for a feeding bottle. When in use with a baby just born, it is necessary to pierce the nipple of the teat with a needle. However, as the baby grows up gradually, he (or she) will have a greater appetite and this will make him or her feel that it is difficult to suck the milk from the feeding bottle if the needle hole in the nipple of the teat is not enlarged. Hence, the nipple of the teat is required to be cut off to increase the flow rate. Nevertheless, it is very difficult to clip the nipple of the teat as desired so that the nipple is often clipped excessively or insufficiently. If the nipple is clipped excessively, the baby will be choked with the milk, and if the nipple is clipped insufficiently the baby will feel that it is difficult to suck the milk from the feeding bottle.

It is, therefore, an object of the present invention to provide a teat for a baby's feeding bottle which may obviate and mitigate the above-mentioned drawbacks.

SUMMARY OF THE INVENTION

Figure 1:
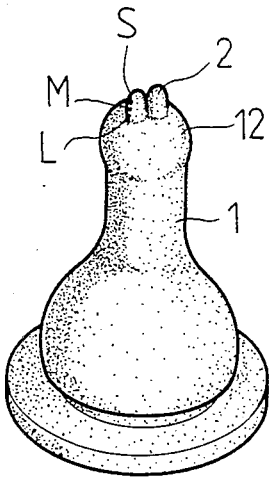
FIG. 1 is a perspective view of the present invention.

This invention relates to an improved teat for babies' feeding bottles.

It is the primary object of the present invention to provide a teat for a feeding bottle which can be adapted for use with babies of different ages.

It is another object of the present invention to provide a teat for a feeding bottle which can be increased in flow rate simply by cutting off the protuberances in the nipples thereof.

It is still another object of the present invention to provide a teat for a feeding bottle which can still be used even if the baby is grown larger.

It is still another object of the present invention to provide a teat for a feeding bottle which is easy to use.

It is a further object of the present invention to provide a teat for a feeding bottle which is simple in construction.

The novel features which are characteristics of the invention, together with further objects and advantages thereof will be better understood from the following description considered in connection with the accompanied drawings and in which a preferred embodiment of the invention is illustrated by way of example. It is to be expressly understood, however, that the drawings are for the purpose of illustration and description only and are not intended as a definition of the limits of the invention.

DETAILED DESCRIPTION OF THE PREFERRED EMBODIMENT

For purposes of promoting an understanding of the principles of the invention, reference will now be made to the embodiment illustrated in the drawings. Specific language will be used to describe the same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
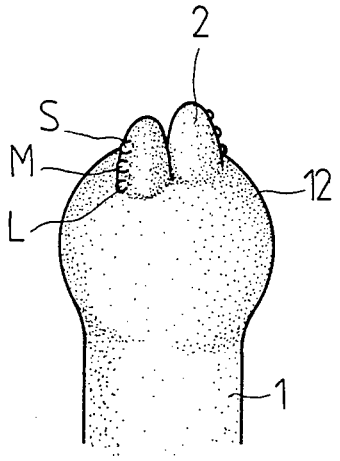
FIG. 2 is an enlarged fragmentary view of the present invention.
Figure 3:
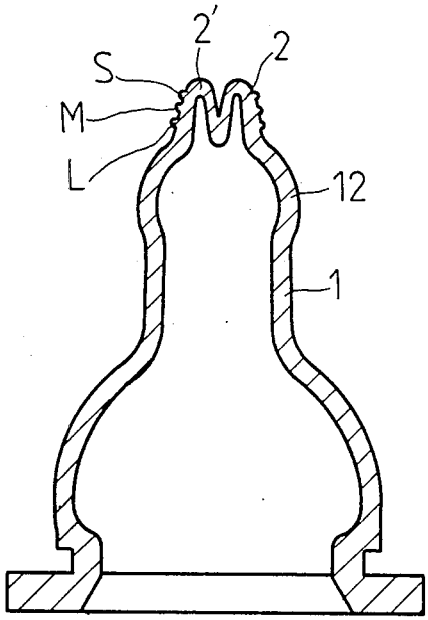
FIG. 3 is a cross-sectional view of the present invention.
Figure 4:
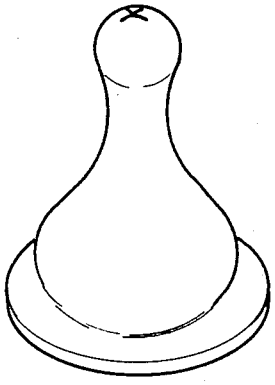
FIG. 4 PRIOR ART
FIG. 4 is a perspective view of a prior art teat.

With reference to the drawings and in particular to FIGS. 1 and 2 thereof, the teat 1 according to the present invention comprises a conical body having two nipples 2 at its top end 12. Each nipple 2 is provided with three protuberances S, M and L at different diameters. When desired to feed a baby of three months or below, simply cut off the nipple at the smallest protuberance S. As for the baby of three to six months, the protuberance M of middle size shows where the nipple is to be clipped. The protuberance L of largest size is of course for the baby of more than six months. Hence, the present invention can be adapted for use with babies of different ages.

Figure 5:
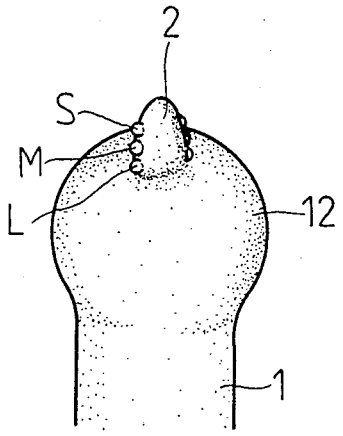
FIG. 5 shows another embodiment of the present invention.

Referring to FIG. 5, there is shown another embodiment of the present invention. As illustrated, the teat comprises only one nipple 2 at its top end 12 the nipple 2 is provided with three protuberances S, M and L at both sides thereof.

Although this invention has been described with a certain degree of particularlity, it is understood that the present disclosure is made by way of example only and that numerous changes in the construction and the combination and arrangement of parts may be resorted to without departing from the spirit and scope of the invention as hereinafter claimed.

I claim:

1. A teat for a feeding bottle comprising a conical body having at least one nipple on the top end thereof, said nipple having at least three protuberances spaced vertically therealong at successively larger diameters, whereby said protuberances serve to designate the appropriate nipple opening for babies of three months or below, three to six months and more than six months of age respectively.

2. A teat for a feeding bottle as in claim 1 wherein said conical body is provided with two nipples on the top end thereof, each nipple having three protuberances spaced verticaly therealong at successively larger diameters.

* * * * *